US005520856A

United States Patent [19]

Garrett et al.

[11] Patent Number: 5,520,856

[45] Date of Patent: May 28, 1996

[54] GAS DISSOLVING

[75] Inventors: Michael E. Garrett, Woking; Godfrey B. Pickworth, High Wycombe, both of England

[73] Assignee: The BOC Group plc, Windlesham, England

[21] Appl. No.: 403,326

[22] Filed: Mar. 14, 1995

[51] Int. Cl.[6] ..... B01F 3/04

[52] U.S. Cl. ..... 261/76; 261/DIG. 75

[58] Field of Search ..... 261/76, DIG. 75

[56] References Cited

U.S. PATENT DOCUMENTS

| | | | |
|---|---|---|---|
| Re. 21,416 | 4/1940 | Sargent | 261/DIG. 75 |
| 2,328,414 | 8/1943 | Beyer | 261/DIG. 75 |
| 3,067,435 | 12/1962 | Nash | 261/DIG. 75 |
| 3,900,420 | 8/1975 | Sebba | 252/307 |
| 4,210,534 | 7/1980 | Molvar | 261/DIG. 75 |
| 4,210,613 | 7/1980 | Webb | 261/77 |
| 4,593,420 | 6/1986 | Tobias et al. | 261/DIG. 75 |
| 4,643,743 | 2/1987 | Grader | 55/26 |
| 5,403,522 | 4/1995 | Von Berg | 261/DIG. 75 |

FOREIGN PATENT DOCUMENTS

| | | | |
|---|---|---|---|
| 0035243 | 9/1981 | European Pat. Off. . | |
| 971536 | 1/1951 | France | 261/76 |
| 545186 | 6/1956 | Spain | 261/76 |
| 245670 | 11/1969 | U.S.S.R. | 261/DIG. 75 |

*Primary Examiner*—Tim R. Miles

*Attorney, Agent, or Firm*—R. Hain Swope; David A. Draegert; Larry R. Cassett

[57] ABSTRACT

An improved apparatus for the introduction of a gas into a liquid comprising a mixing device formed by a first generally convergent section and a second generally divergent section, said first section having a narrow outlet end of smaller diameter than an inlet end of said second section and extending thereinto so as to form an annular gap therebetween, and supply means for supplying said gas to said annular gap so as to facilitate the mixing of said gas with any liquid passing therethrough. The mixing device is preferably positioned at or near the surface of the liquid so as to avoid problems associated with hydrostatic head. The apparatus is advantageous in the treatment of a liquid with oxygen which is preferably generated by a Pressure Swing Adsorption device.

9 Claims, 1 Drawing Sheet

GAS DISSOLVING

The present invention relates to gas dissolving and relates particularly, but not exclusively, to dissolving oxygen in water.

BACKGROUND OF THE INVENTION

In treating sewage, it is often necessary to dissolve large quantities of oxygen in the sewage so as to oxygenate it. Presently known methods include The BOC Group Plc's VITOX® apparatus as described in British Patent Number 1,455,567. This apparatus comprises a venturi device having a plurality of small holes provided around the circumference of the throat for the introduction of oxygen into the liquid passing through the venturi. Oxygen is generally provided from a liquid store and the pressure of the released gas is usually over 6 bar(g) and sufficiently above the 1.8 bar(g) operating pressure of the VITOX® unit to ensure the oxygen can be introduced into the liquid. Alternatively, one could arrange the venturi such that its operating pressure in the venturi throat is somewhat lower than normal and hence less gas pressure would be required to ensure the oxygen is passed into the liquid. This alternative arrangement is not a preferred one as typically only 80% of the lost liquid pressure is regained by the venturi and, hence, a large amount of energy has to be expended in liquid pumps to provide the extra pressure.

An improvement in such apparatus is provided in accordance with the present invention which pertains to an apparatus for introducing oxygen into a liquid, such as sewage, that is particularly well suited to operation at low gas pressures without increasing liquid pressures thereby reducing energy wastage and improving efficiency.

SUMMARY OF THE INVENTION

The present invention provides an apparatus for introducing a gas into a liquid comprising a duct formed by a first generally convergent section and a second generally divergent section, said first section having a narrow outlet end of smaller diameter than an inlet end of said second section and extending thereinto so as to form an annular gap therebetween, and supply means for supplying gas to said annular gap so as to facilitate the mixing of said gas with any liquid passing through said duct.

DETAILED DESCRIPTION OF THE PREFERRED EMBODIMENTS

The apparatus of the present invention comprises a duct formed by a first generally convergent section and a second generally divergent section, said first section having a narrow outlet end of smaller diameter than an inlet end of said second section and extending thereinto so as to form an annular gap therebetween, and supply means for supplying gas to said annular gap so as to facilitate the mixing of said gas with any liquid passing through said duct.

Preferably, the apparatus further includes a plurality of axially extending circumferentially spaced slots in the first section, each slot being in flow communication with said supply means so as to facilitate the further introduction of gas into any liquid passing through said duct. The apparatus preferably further includes a plenum chamber for receiving gas to be dissolved in said liquid and for directing said gas to said annular gap and said slots.

In a further preferred embodiment of the subject apparatus, the plenum chamber comprises a wall portion extending between said first and second sections and overlying portions of said first and second sections. Said wall portion preferably comprises a right circular tube extending around the entire circumference of the said portions of the said first and second sections.

In a still further preferred embodiment, the apparatus includes a plurality of drain holes in said second section and extending between said plenum chamber and the interior of said second section so as to facilitate the draining of gas into the liquid in said second section.

In a particularly preferred embodiment, said first and/or said second sections comprise truncated cones.

The supply means for supplying gas to the said annular gap, said slots and/or the said drain holes is preferably a Pressure Swing Adsorption ("PSA") device, particularly wherein the gas to be supplied is oxygen.

Figure 1:
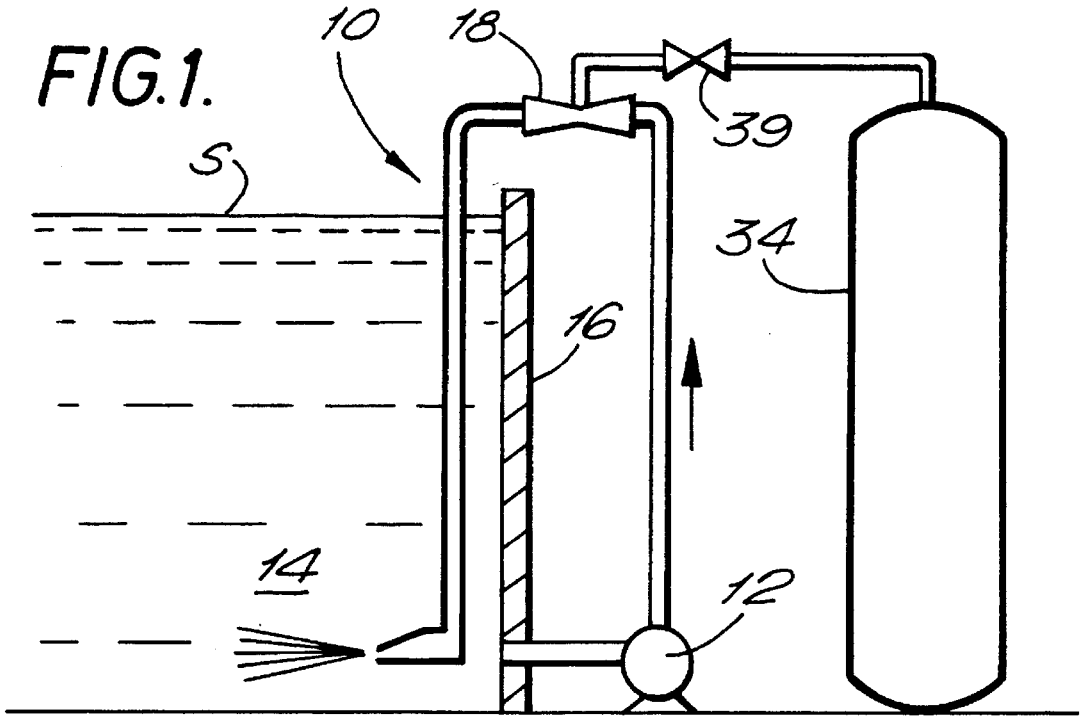
FIG. 1 is a general view of an apparatus according to the present invention.
Figure 2:
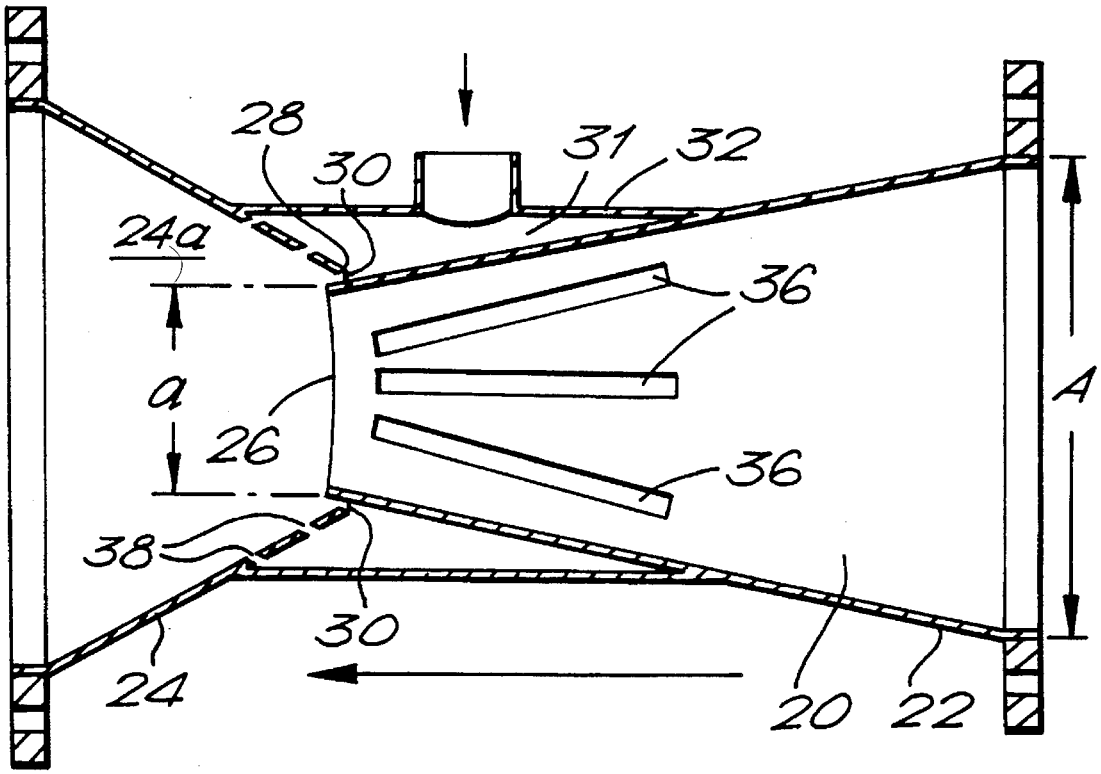
FIG. 2 is a cross sectional view of the venturi mixing device illustrated in FIG. 1.

Referring to FIG. 1, an apparatus 10 for dissolving a gas in a liquid comprises a pump 12 for drawing a quantity of liquid 14 from, for example, a storage tank 16 and to a mixing device shown at 18 and illustrated in detail in FIG. 2. An oxygen PSA device 34 is linked via a control valve 39 to the mixing device 18 for the supply of oxygen at an unboosted pressure whilst the mixing device itself is positioned at or near the surface S of any liquid contained in tank 16 thereby minimizing any hydrostatic head.

The water velocity through the venturi and the ratio of area change A/a are selected so as to produce a throat pressure of about 0.6 bar(g). Provided that excessive hydrostatic head is avoided this pressure is adequate to ensure oxygen gas is drawn directly from the PSA device which operates at a typical output pressure of between 1 to 1.5 bar(g).

Referring to FIG. 2, the mixing device 18 comprises a duct 20 formed by a first generally convergent section such as, for example, truncated cone 22 and a second generally divergent section 24. The first section is provided with a narrow outlet end 26 of smaller diameter than the inlet end 28 of said second section 24 and extending into said inlet 28 so as to define an annular gap 30 therebetween. A plenum chamber 31 formed by a wall portion in the form of, for example, right circular tube section 32 extending between said first and second sections 22, 24 and overlying portions of said first and second sections is provided for receiving gas from a source thereof 34 (FIG. 1) and for directing it to said annular gap for passage therethrough. The mixing device 18 may further include a plurality of axially extending circumferentially spaced slots 36 in the first section 22 and/or a plurality of drain holes 38 in the second section 24 extending between the plenum chamber 31 and the interior **24*a* of the second section 24 for the draining of liquid from said plenum chamber 31 and/or the introduction of gas into liquid in said second section 24**.

In operation, pump 12 acts to pump liquid 14 from tank 16 up to the mixing device 18 and pass it therethrough at about 5 m/s and about 0.6 bar(g). Since the unboosted PSA device delivers oxygen at between 1 to 1.5 bar(g) there will be sufficient positive oxygen pressure to ensure oxygen is introduced into the periphery of the liquid flow and hence mixed therewith for dispersion downstream.

Certain design features of the above mentioned mixing device are particularly well suited to low pressure mixing. The annular gap 30, for instance, allows gas to be introduced at the periphery of the liquid passing through the device and makes use of the power in the liquid to 'entrain' the gas in a manner which allows gas introduction to take place at a lower differential pressure ratio than had previously been thought possible. Additionally, further mixing is guaranteed as the liquid expands in a turbulent manner into the generally divergent section 24. Clearly, because of the lower pressures involved it might be necessary to provide additional passages for the gas, slots 36 are particularly useful for this purpose as they may be oversized relative to the typical circular holes provided in known mixers. The oversizing is in proportion to the reduction in operating pressure relative to known mixers and allows for a longer 'residency' that is to say a longer contact period between liquid and gas. The longer the contact period, the greater the chance of gas mixing occurring. The subject apparatus is particularly advantageous for oxygenating liquids such as sewage. Drain holes 38 act to allow any liquid drained into the plenum chamber 31 to be purged therefrom and may also act to introduce gas into the comparatively turbulent downstream divergent zone 24*a* where further mixing is undertaken.

We claim:

1. An apparatus for introducing a gas into a liquid comprising:

(a) a duct for passing the liquid therethrough, said duct comprising a first section generally convergent in the downstream direction and a second section generally divergent in the downstream direction, said first section comprising (i) a plurality of axially extending circumferentially spaced slots with each slot being in flow communication with a gas supply means, and (ii) an outlet end of smaller diameter than an inlet end of said second section, said outlet end extending into the second section so as to form an annular gap between the first and second sections; and (b) gas supply means for supplying said gas to said annular gap so as to facilitate the mixing of said gas with the liquid passing through the duct.

2. The apparatus of claim 1 wherein at least one of said first and second sections comprises a truncated cone.

3. The apparatus of claim 1 further comprising liquid supply means, said apparatus being positioned at or about the same level as the surface of said liquid contained in said liquid supply means.

4. The apparatus of claim 1 wherein said gas supply means comprises means for generating an oxygen-containing gas.

5. The apparatus of claim 4 wherein said gas supply means comprises a pressure swing adsorption device for generating the oxygen-containing gas.

6. The apparatus of claim 1 further comprising a plenum chamber for receiving said gas to be introduced into said liquid and for directing said gas to said annular chamber and said slots.

7. The apparatus of claim 6 further comprising a plurality of drain holes extending between said plenum chamber and the interior of said second section so as to facilitate the passage of the gas into the liquid in said second section.

8. The apparatus of claim 6 wherein said plenum chamber comprises a wall portion extending between said first and second sections and overlying a portion of said first section and a portion of said second section.

9. The apparatus of claim 8 wherein said wall portion comprises a right circular tube extending around the circumference of said portions of the first and second sections.

* * * * *